United States Patent [19]

Dudt

[11] 4,278,447

[45] Jul. 14, 1981

[54] METHODS FOR PRODUCING FEEDSTOCK FOR A FIXED BED GASIFIER FROM FINELY-DIVIDED COAL

[75] Inventor: Philip J. Dudt, Scenery Hill, Pa.

[73] Assignee: Conoco, Inc., Stamford, Conn.

[21] Appl. No.: 95,022

[22] Filed: Nov. 16, 1979

[51] Int. Cl.[3] ..... C10J 3/00

[52] U.S. Cl. ..... 48/210; 44/1 F; 44/10 C; 44/23; 201/31; 201/33; 252/373

[58] Field of Search ..... 44/10 C, 1 B, 1 F, 23, 44/10 R; 252/373; 201/5, 6, 9, 31, 33, 23, 29, 37, 28; 48/210, 203, 206; 23/313 FB, 314

[56] References Cited

U.S. PATENT DOCUMENTS

| | | | |
|---|---|---|---|
| 1,682,195 | 8/1928 | Sheehan | 44/23 |
| 2,288,087 | 6/1942 | Hanson et al. | 23/314 |
| 3,368,012 | 2/1968 | Erickson | 201/5 |
| 3,401,089 | 9/1968 | Friedrich et al. | 201/6 |
| 3,454,382 | 7/1962 | Hamilton | 48/76 |
| 3,692,505 | 9/1972 | Reichl | 48/203 |
| 4,071,329 | 1/1978 | Eales | 48/62 R |
| 4,073,627 | 2/1978 | Anderson | 48/62 R |
| 4,078,903 | 3/1978 | Eales | 48/62 R |

OTHER PUBLICATIONS

Struck et al., "Small Continuous Unit for Fluidized Coal Carbonization," *I & EC Process Design and Development,* vol. 6, p. 85, Jan. 1967.

*Primary Examiner*—S. Leon Bashore
*Assistant Examiner*—Michael Goldman
*Attorney, Agent, or Firm*—F. Lindsey Scott; William A. Mikesell, Jr.

[57] ABSTRACT

A process for producing a feedstock for a fixed bed gasifier from finely-divided coal by treating the coal in a first stirred semi-fluidized carbonizer reaction zone to produce particulate coal derived solids larger than the finely-divided coal charged to the first carbonizer and thereafter charging the particulate coal derived solids so produced to a second stirred semi-fluidized carbonizer reaction zone to produce particulate coal derived solids of a size consist greater than ¼ inch which is charged to a fixed bed gasifier.

13 Claims, 1 Drawing Figure

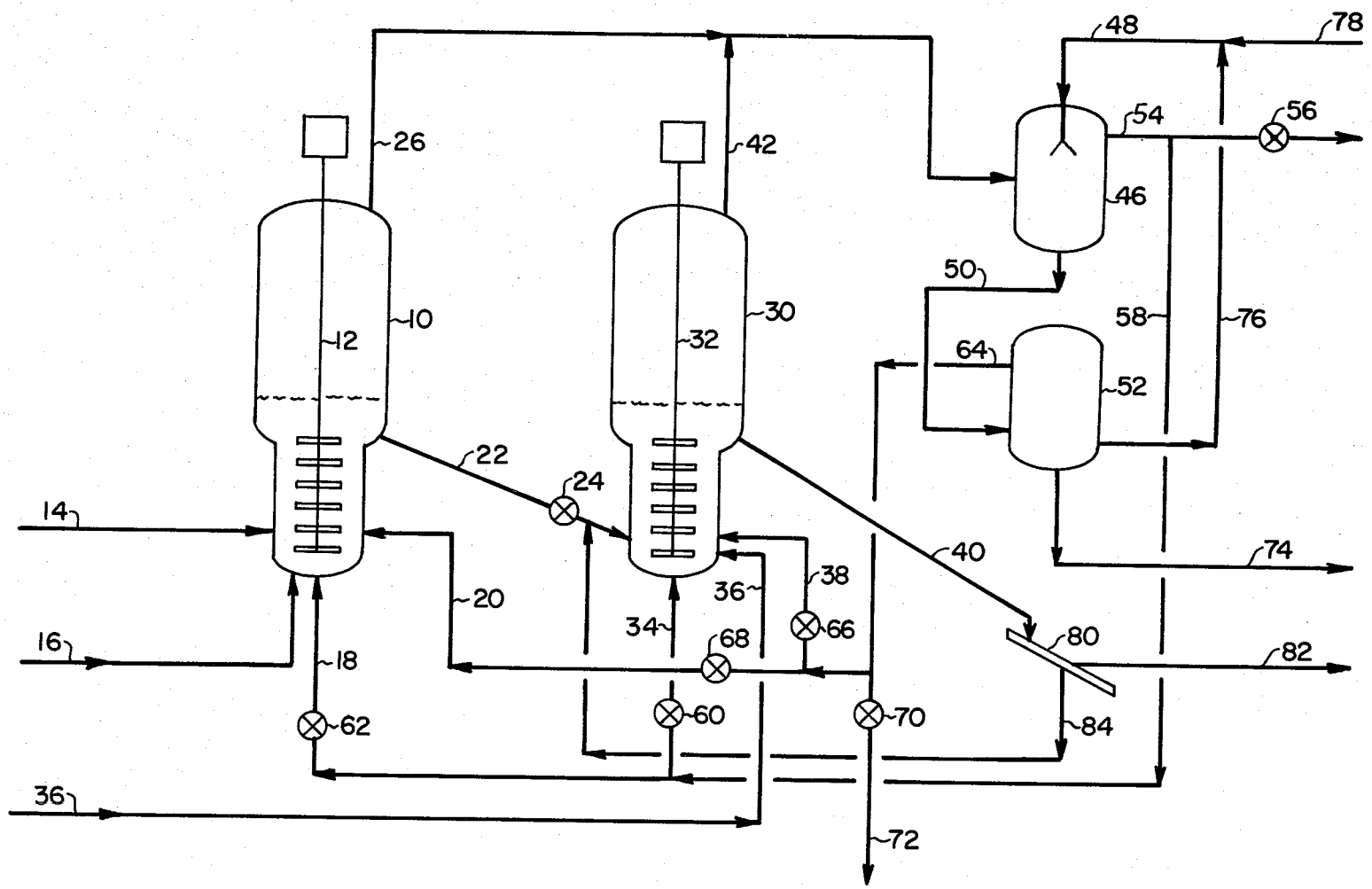
78
56
76
74
82
48
54
46
58
52
80
84
50
64
40
70
72
38
66
42
30
36
68
60
32
34
24
22
20
26
10
12
18
62
14
16
36

METHODS FOR PRODUCING FEEDSTOCK FOR A FIXED BED GASIFIER FROM FINELY-DIVIDED COAL

This invention relates to the production of fixed bed gasifier feedstock in stirred semi-fluidized carbonizers.

This invention further relates to the production of feedstock for a fixed bed gasifier by the use of two stirred semi-fluidized carbonizer reaction zones to produce particulate coal derived solids having a size consist greater than ¼ inch.

In a prior art search conducted on the concept of the subject invention, the following references were discovered:

U.S. Pat. No. 1,723,932 Greene et al.
U.S. Pat. No. 2,502,141 Galusha
U.S. Pat. No. 3,454,382 Hamilton
U.S. Pat. No. 3,047,472 Gorin et al.

These references are hereby incorporated by reference.

In recent years, a considerable amount of effort has been directed to the development of methods for producing synthetic natural gas fuels. One approach to the production of such fuels from commonly occurring carbonaceous materials such as coal of various grades and the like, has been the use of fixed bed gasifiers of various types. The fixed bed gasifiers may be of a non-slagging or slagging variety as known to those skilled in the art. Particularly in slagging gasifiers such as shown for instance in U.S. Pat. No. 4,071,329 issued Jan. 31, 1978, U.S. Pat. No. 4,073,627 issued Feb. 14, 1978 and U.S. Pat. No. 4,078,903 issued Mar. 14, 1978 the use of finely-divided coals is undesirable. The finely-divided coal tends to be carried overhead in the gaseous stream from the reactor rather than passing downwardly through the reactor to produce the desired synthesis gas product. As a result, fixed bed gasifiers typically require a feedstock having a size consist from about ¼ to about 1¼ inches. Larger sizes could of course be used but difficulties in handling are frequently encountered when larger particle sizes are used. While minor amounts of finely-divided coal can be used in fixed bed gasifiers by injecting the finely-divided coal through the tuyeres, or the like, it has been found that run of mine coal normally contains a higher proportion of fines than can be used, especially after the coal has been crushed to the desired feed size. As a result a continuing effort has been directed to the development of methods whereby the entire run of mine coal feedstream can be charged to the fixed bed gasifier.

It has now been found, that such an objective is achieved by charging the finely-divided coal to a first stirred semi-fluidized carbonizer reaction zone where inert gas is used in combination with stirring to maintain the bed of solids in the reaction zone in a semi-fluidized state with oxygen being added in an amount sufficient to maintain the temperature in the reaction zone from about 950° to about 1200° F. to produce a gaseous overhead stream from the reaction zone and a first particulate coal derived solids stream having a size consist greater than the finely-divided coal. The resulting particulate coal derived solids stream is charged to a second stirred semi-fluidized carbonizer reaction zone which is operated in a similar fashion to produce a second particulate coal derived solids stream which has an average particulate size consist greater than ¼ inch for use as a feedstock to a fixed bed gasifier.

The FIGURE is a schematic diagram of an embodiment of the process of the present invention. In the FIGURE, a first stirred semi-fluidized carbonizer 10 including a stirrer 12 is shown. Finely-divided coal is charged to first carbonizer 10 through a line 14 with air being charged through a line 16 and an inert sweep gas being charged through a line 18. First carbonizer 10 is operated at a temperature from about 950° to about 1200° F. and at a relatively low pressure typically less than 100 psig and desirably as low as about 10 psig. An overhead gaseous stream is recovered from first carbonizer 10 through a line 26 and passed to further processing. A particulate solids stream is recovered from first carbonizer 10 through a line 22 and passed to a second stirred semi-fluidized carbonizer 30. Flow is regulated through line 22 by a valve 24. Second carbonizer 30 includes a stirrer 32. Inert sweep gas is charged to second carbonizer 30 through a line 34 with coal being charged to second carbonizer 30 via a line 36 and particulate solids being recovered from second carbonizer 30 via a line 40. Second carbonizer 30 operates at substantially the same conditions as first carbonizer 10 and a gaseous stream is recovered from second carbonizer 30 via a line 42 and optionally combined with the gaseous stream recovered from first carbonizer 10 via line 26 and passed to further gas processing. The product solids stream recovered through line 40 is desirably passed to a screen 80 where the solids stream is separated into a solids stream having a size consist greater than ¼ inch which is passed to use as a fixed bed gasifier feedstock via a line 82 with the undersized solids material being recycled via a line 84 to second carbonizer 30.

The gaseous stream recovered from lines 26 and 42 is desirably filtered (filters not shown) and thereafter passed to cooling or scrubbing in a scrubber 46. Scrubber 46 as shown is used to countercurrently contact the gaseous stream flowing from line 26 with water supplied through a line 48 to cool the gaseous stream and remove condensible material from the gaseous stream. The resulting scrubbed gaseous stream is recovered through a line 54 and may be passed to use as a high Btu gas or the like. A portion of the scrubbed gas may be recycled for use as the inert sweep gas. Such a recycle gas stream is shown with the recycled gas flowing through a line 58 to first carbonizer 10 via line 18 and a valve 62 and to second carbonizer 30 via line 34 and a valve 60. The portion of the gaseous stream flowing to product is regulated by a valve 56. The aqueous stream containing condensed tars, solids and the like is withdrawn from the lower portion of scrubber 46 via a line 50 and passed to a decanter 52. In decanter 52 the organic materials and the water are allowed to separate with tars and the like being withdrawn through a line 64 and optionally passed to recycle to first carbonizer 10 via a line 20 and second carbonizer 30 via a line 38. The flow through line 20 is regulated by a valve 68 with the flow through line 38 being regulated by a valve 66. A line 72 regulated by a valve 70 is shown for passing a portion of the tars to product or other use. A line 74 is provided for withdrawing solids and the like from the bottom of decanter 52 as required. Makeup water as required is supplied by a line 78.

In the practice of the process of the present invention, stirred semi-fluidized carbonizers have been found to be particularly effective in forming finely-divided coal into larger particulate solids. The inert sweep gas is supplied at a rate sufficient to provide a linear velocity in the carbonizer reaction zones from about 0.1 to about 0.5 feet/second. Typically, the sweep gas is supplied in an amount equal to from about 5 to about 25 standard cubic feet/pound of moisture and ash free coal feed. Preferably, the amount used is from 5 to 15 cubic feet/-pound of moisture and ash free coal feed. Solids residence times in the carbonizer vessels are from about 30 to about 60 minutes. The operating temperature in the carbonizer vessels is from about 950° to about 1200° F. with the higher temperatures, i.e. greater than about 1000° F. being preferred since the higher temperatures result in the production of more tar which results in the production of particulate solids which produce less tar upon gasification. The tar produced by the present process is relatively solids free and is suitable for use as a hydrocracker feedstock, heavy fuel oil or a source of tar acids. The offgases produced through line 54 comprise a relatively high Btu gas which may be used as a fuel or passed to further processing.

The coal charged to first carbonizer 10 is usually smaller than about 8 Tyler mesh and is desirably smaller than about 14 Tyler mesh. The coal charged to first carbonizer 10 is treated at the conditions indicated and results in the production of particulate solids having a size consist greater than that of the charged coal and as a result of the presence of air in first carbonizer 10, the particles so formed have a relatively rough porous surface which lends itself well to further growth by agglomeration in second carbonizer 30. In second carbonizer 30, additional coal is supplied and blends with the particulate solids supplied through line 22 to produce larger particulate solids.

When caking coal is used, the presence of air in first carbonizer 10 tends to oxidize the coal thus reducing its tendency to agglomerate as well as oxidize a portion of the material to produce the heat necessary for the operation of first carbonizer 10. The use of caking coal in second carbonizer 30 may result in some instances in the production of slightly tacky particulate solids through line 40 but upon cooling, hard particulate solids are produced which are suitable for use as a feedstock to a fixed bed gasifier.

When a non-caking or semi-caking coal feedstock is used, it is desirable and in some instances necessary to supply a carbonaceous binder through a line 18 to first carbonizer 10 to agglomerate the finely-divided coal. The carbonaceous binder is supplied in an amount less than about 15 weight percent based upon the moisture and ash free coal fed to the carbonizer. Desirably the carbonaceous material is supplied in an amount equal to from about 10 to about 12 weight percent. Carbonaceous binder is also charged to second carbonizer 30 when non-caking or semi-caking coals are used. The binder is used in an amount less than about 15 weight percent based upon the moisture and ash free coal fed to second carbonizer 30. Desirably the carbonaceous binder used is a recycle tar stream recovered through line 64 from decanter 52 having a boiling point greater than about 700° F. While reference has been made herein to caking, non-caking and semi-caking coals, it is noted that most coals will exhibit caking or non-caking character under the conditions of the present process. In other words, a coal is a caking coal if it tends to soften, become tacky and otherwise tend to cake under the reaction conditions, whereas coals which do not tend to soften become tacky or tend to cake under the conditions in the carbonizers are considered to be non-caking. It is possible that some coals may be in between and in such instances more or less carbonaceous binder may be required. In any event the variations in the operation of the present process to accommodate such semi-caking coals are considered to be within the skill of those in the art based upon the foregoing description of preferred embodiments.

As indicated, the undersize material recovered from screen 80 is passed to recycle to second carbonizer 30. Such solids are readily adapted to further growth to produce larger particulate solids for use as a feedstock to a fixed bed gasifier.

A further advantage achieved in the practice of the present invention in conjunction with fixed bed gasifiers lies in the production of a solids product which upon processing in a fixed bed gasifier yields less tar and other condensible materials than do commonly used coal feedstocks. The handling of such condensible materials is more readily accomplished in carbonizer vessels such as described herein than in fixed bed gasifiers. As a result, a desirable by-product, i.e. low solids tars, is produced by the method of the present invention and a high Btu gas stream is produced which may be combined with that produced in the fixed bed gasifier.

The operation of semi-fluidized stirred carbonizing vessels such as used in the process of the present invention is described briefly on a laboratory scale in an article entitled "Small Continuous Unit for Fluidized Coal Carbonization," I&EC, Process Design and Development, Vol. 6, p. 85, Jan. 1967, by Robert T. Struck, Philip J. Dudt, and Everett Gorin. This reference is hereby incorporated in its entirety by reference.

Having thus described the present invention by reference to its preferred embodiments it is pointed out that the embodiments described are illustrative rather than limiting in nature and that many variations and modifications are possible within the scope of the present invention. Such variations and modifications may appear obvious and desirable to those skilled in the art based upon the foregoing description of preferred embodiments.

Having thus described the invention, I claim:

1. A process for gasifying a feedstock, produced from finely divided coal, in a fixed bed gasifier comprising:

(a) charging said finely divided coal to a first stirred semi-fluidized carbonizer reaction zone;

(b) charging a free oxygen containing gas to said first reaction zone in an amount sufficient to maintain a temperature from about 950° to about 1200° F. in said first reaction zone;

(c) passing an inert sweep gas upwardly through said first reaction zone at a rate sufficient to provide a linear gas velocity in said first reaction zone from about 0.1 to about 0.5 feet per second;

(d) recovering a gaseous stream from said first reaction zone;

(e) recovering a first particulate coal derived solids stream from said first reaction zone said first particulate coal derived solids stream having a larger average particle size than said finely divided coal;

(f) charging said first particulate coal derived solids stream to a second semi-fluidized stirred carbonizer reaction zone;

(g) charging said finely divided coal to said second reaction zone;

(h) passing an inert sweep gas upwardly through said second reaction zone at a rate sufficient to provide a linear gas velocity in said second reaction zone from about 0.1 to about 0.5 feet per second;

(i) recovering a gaseous stream from said second reaction zone;

(j) recovering a second particulate coal derived solids stream, from said second reaction zone, said second particulate coal derived solids stream having an average particle size greater than ¼ inch and larger than said first particulate coal derived solids stream; and (k) charging the portion of said second particulate coal derived solids stream of a size consist larger than about ¼ inch to the fixed bed gasifier.

2. The process of claim 1 wherein said coal is a non-caking or semi-caking coal and wherein a carbonaceous binder is charged to said first reaction zone and to said second reaction zone.

3. A process for gasifying a feedstock, produced from finely divided caking coal in a fixed bed gasifier consisting essentially of (a) charging said finely divided coal to a first stirred semi-fluidized carbonizer reaction zone;

(b) charging a free oxygen containing gas to said first reaction zone in an amount sufficient to maintain a temperature from about 950° to about 1200° F. in said first reaction zone;

(c) passing an inert sweep gas upwardly through said first reaction zone at a rate equal to from about 5 to about 25 standard cubic feet per pound of coal feed;

(d) recovering a gaseous stream from said first reaction zone;

(e) recovering a first particulate coal derived solids stream, from said first reaction zone, said first particulate coal derived solids stream having a larger average particle size than said finely divided coal;

(f) charging said first particulate coal derived solids stream to a second stirred semi-fluidized carbonizer reaction zone;

(g) charging said finely divided coal to said second reaction zone;

(h) passing an inert sweep gas upwardly through said second reaction zone at a rate sufficient to provide a linear gas velocity in said second reaction zone from about 0.1 to about 0.5 feet per second;

(i) recovering a gaseous stream from said second reaction zone;

(j) recovering a second particulate coal derived solids stream, from said second reaction zone, said second particulate coal derived solids stream having an average particle size greater than ¼ inch and larger then said first particulate coal derived solids stream; and, (k) charging the portion of said second particulate coal derived solids stream of a size consist larger than about ¼ inch to the fixed bed gasifier.

4. The process of claim 3 wherein said gaseous stream from said first reaction zone and said second reaction zone are combined and passed to further treatment to yield a low solids tar and a gaseous stream suitable for use as said inert sweep gas.

5. The process of claim 3 wherein said second particulate solids stream is separated into a product solids stream of particulate solids larger than a desired minimum and an undersize solids stream of particulate solids smaller than a desired minimum.

6. The process of claim 5 wherein said undersize solids steam is recycled to said second reaction zone.

7. The process of claim 3 wherein said second reaction zone is at a temperature from about 950° to about 1200° F.

8. A process for gasifying a feedstock, produced from finely divided non-caking or semi-caking coal, in a fixed bed gasifier consisting essentially of (a) charging said finely divided coal to a first stirred semi-fluidized carbonizer reaction zone;

(b) charging a free oxygen containing gas to said first reaction zone in an amount sufficient to maintain a temperature from about 950° to about 1200° F. in said first reaction zone;

(c) charging a carbonaceous binder stream to said first reaction zone;

(d) passing an inert sweep gas upwardly through said first reaction zone at a rate equal to from about 5 to about 25 standard cubic feet per pound of coal feed;

(e) recovering a gaseous stream from said first reaction zone;

(f) recovering a first particulate coal derived solids stream, from said first reaction zone said first particulate coal derived solids stream having a larger average particle size than said finely divided coal;

(g) charging said first particulate coal derived solids stream to a second stirred semi-fluidized carbonizer reaction zone;

(h) charging said finely divided coal to said second reaction zone;

(i) charging a carbonaceous binder stream to said second reaction zone;

(j) passing an inert sweep gas upwardly through said second reaction zone at a rate sufficient to provide a linear gas velocity in said second reaction zone from about 0.1 to about 0.5 feet per second;

(k) recovering a gaseous stream from said second reaction zone;

(l) recovering a second particulate coal derived solids stream, from said second reaction zone, said second particulate coal derived solids stream having an average particle size greater than ¼ inch and larger than said first particulate coal derived solids stream; and, (m) charging the portion of said second particulate coal derived solids stream of a size consist larger than about ¼ inch to the fixed bed gasifier.

9. The process of claim 8 wherein said gaseous stream from said first reaction zone and said second reaction zone are combined and passed to further treatment to yield a low solids tar and a gaseous stream suitable for use as said inert sweep gas.

10. The process of claim 9 wherein said tar is recycled to said first reaction zone and to said second reaction zone as said carbonaceous binder.

11. The process of claim 8 wherein said second particulate solids stream is separated into a product solids stream of particulate solids larger than a desired minimum and an undersize solids stream of particulate solids smaller than a desired minimum.

12. The process of claim 11 wherein said undersize solids stream is recycled to said second reaction zone.

13. The process of claim 8 wherein said second reaction zone is at a temperature from about 950° to about 1200° F.

* * * * *